United States Patent [19]

Yamagata et al.

[11] Patent Number: 4,468,111

[45] Date of Patent: Aug. 28, 1984

[54] DEVELOPING DEVICE FOR USE ON AN ELECTROSTATIC COPYING APPARATUS

[75] Inventors: Ryutaro Yamagata, Hyogo; Nobuhiko Kozuka, Osaka; Hitoshi Nishihama, Osaka; Shigeo Koyama, Osaka; Kazutada Sakai, Osaka, all of Japan

[73] Assignee: Mita Industrial Company Limited, Osaka, Japan

[21] Appl. No.: 409,108

[22] Filed: Aug. 18, 1982

Related U.S. Application Data

[62] Division of Ser. No. 265,565, May 20, 1981, Pat. No. 4,436,412.

[51] Int. Cl.[3] ..... G03G 15/09

[52] U.S. Cl. ..... 355/3 DD; 118/658

[58] Field of Search ..... 355/3 R, 3 DD; 118/653–658

[56] References Cited

U.S. PATENT DOCUMENTS

| | | | |
|---|---|---|---|
| 4,226,524 | 10/1980 | Hashimoto | 355/3 DD |
| 4,261,290 | 4/1981 | Yamashita et al. | 355/3 DD |
| 4,332,467 | 6/1982 | Kimura | 355/3 DD |
| 4,377,334 | 3/1983 | Nishikawa | 355/3 DD |

*Primary Examiner*—R. L. Moses

*Attorney, Agent, or Firm*—Wenderoth, Lind & Ponack

[57] ABSTRACT

An electrostatic copying machine apparatus includes a developing device having a fixedly positioned permanent magnet and a hollow developing sleeve formed of a non-magnetic material mounted coaxially about the permanent magnet for rotation thereabout. Toner supplied to the periphery of the sleeve forms thereon a magnetic brush which is conveyed by rotation of the sleeve to a developing position whereat the toner is transferred to a photoreceptor as a visible toner image. A bristle cutting member is positioned upstream of the developing position to restrict the length of the magnetic brush. A blade member formed of a non-magnetizable material prevents solidification of the toner on the periphery of the sleeve and is positioned upstream of the bristle cutting member. The blade member slides in contact with the periphery of the sleeve at a scraping position. The permanent magnet has spaced thereabout at equal circumferential intervals a plurality of magnetizing positions having magnetic poles. One pole is at a first magnetizing position confronting the bristle cutting member, and another pole is at a second magnetizing position confronting the scraping positions. These two poles are of opposite polarities and are adjacent to each other. At least one magnetizing position includes a pair of poles of the same polarity.

8 Claims, 15 Drawing Figures

DEVELOPING DEVICE FOR USE ON AN ELECTROSTATIC COPYING APPARATUS

This is a division of application Ser. No. 265,565, filed May 20, 1981, now U.S. Pat. No. 4,936,412.

BACKGROUND OF THE INVENTION

1. Field of the Invention

The present invention relates to a developing device for use in an electrostatic copying apparatus and more particularly, to a developing device of this kind which is so arranged that, by supplying mono-component magnetizable toner onto a developing sleeve which is driven for rotation, a magnetic brush is formed on the developing sleeve by the action of a stationary permanent magnet provided within the developing sleeve, while the bristle length of the magnetic brush is restricted by a bristle cutting member.

2. Description of the Prior Art

Conventionally, in a developing apparatus which is arranged to form a magnetic brush by supplying mono-component magnetizable toner onto the peripheral surface of a developing sleeve to be rotated around a stationary permanent magnet, the surplus mono-component magnetizable toner of the magnetic brush cut off by the bristle cutting member for restricting the bristle length tends to stay stationarily at the upstream side of the bristle cutting member with respect to the rotational direction of the developing sleeve, thereby to cause the mono-component magnetizable toner to be solidified. Thus, an undesirable blocking phenomenon is liable to take place. Upon occurrence of the blocking phenomenon as described above, the mono-component magnetizable toner is blocked by the solidified mono-component magnetizable toner and can not be transported up to the developing position, thus making it impossible to effect developing.

Meanwhile, the remaining mono-component magnetizable toner which has not been used for development at the developing position is continuously rotated as it is attracted onto the predetermined position of the developing sleeve, thereby to be magnetized by the powerful magnetizing action from the permanent magnet, with corresponding reduction of fluidity of the mono-component magnetizable toner. Accordingly, the state of brush bristles of the magnetic brush can be maintained constant, thus resulting in irregular development through reduction of developing efficiency.

Accordingly, an object of the invention is to provide an improved developing apparatus for use in an electrostatic copying apparatus which is capable of preventing the blocking phenomenon of the mono-component magnetizable toner by a bristle cutting member, and also capable of maintaining the proper fluidity of the mono-component magnetizable toner and also uniformity of formation of the brush bristles of the magnetic brush, through solution of the technical problems as described above.

In the prior art developing device which is arranged to form a magnetic brush by supplying developing material onto a developing roller for development by rubbing a photoreceptor against the magnetic brush, there have been such disadvantages that the developing material accommodated in the storage container is formed into lumps so as to cause the so-called blocking phenomenon. Thus, smooth supply of the developing material from the storage container to the developing roller is obstructed, consequently giving rise to faulty developments such as irregular developing, insufficient developing, etc. Especially, when the mono-component magnetizable toner is employed as the developing material, the undesirable blocking phenomenon tends to take place more easily, since particle diameters thereof are generally small, i.e. in the region of 5 to 30$\mu$. For solving the technical problems as described above, there has conventionally been proposed an arrangement in which a stirring or agitating means to be driven by a main motor of the electrostatic copying apparatus is provided in the storage container. However, the known arrangement as described above also has a disadvantage in that the construction thereof is complicated.

Accordingly, another object of the invention is to provide an improved developing device capable of preventing the blocking of the developing material within the storage container, and also capable of supplying the developing material to the developing roller by approximately a predetermined amount through simple construction, with substantial elimination of the technical problems inherent in the prior art arrangements as described above.

The invention still further relates to a device for detecting the presence of a developing material in a developing device for use in an electrostatic copying apparatus, and more particularly to such a presence detection device for use in a developing device arranged to form a magnetic brush by supplying developing material onto the peripheral surface of a developing sleeve provided therein with a stationary permanent magnet and driven for rotation.

In a typical prior art device is arranged to effect detection by a light detector such as a photo-cell. But such a known arrangement has a disadvantage that such an optical detecting mechanism as described above is complicated in construction and generally expensive.

Accordingly, an another object of the invention is to provide an inexpensive presence detection device with simple construction for use in a developing device of an electrostatic copying apparatus.

SUMMARY OF THE INVENTION

These objects are achieved according to the invention by providing an improved developing device for an electrostatic copying apparatus in which a permanent magnet having a plurality of magnetic poles magnetized at equal intervals in the peripheral direction of the permanent magnet is coaxially secured in a hollow developing sleeve made of non-magnetic material and driven to rotate. A one-component magnetizable toner is supplied onto the developing sleeve so as form a magnetic brush, and a bristle cutting member restricts a length of the magnetic brush. There is provided a blade member made of non-magnetic material and disposed upstream and in the vicinity of the bristle cutting member with respect to the rotational direction of the developing sleeve, The blade member is inclined in an upstream direction and contacts the peripheral surface of the developing sleeve to separate therefrom toner moving downstream in the rotational direction. Adjacent magnetic poles have alternately opposite polar orientation. Those magnetic poles formed at a magnetized position facing the bristle cutting member and a magnetized position contacting the blade member are adjacent and of opposite polarity. The blade member has a construction to allow the one-component magnetizable toner pass at about a central position between the magnetic pole facing the bristle cutting member and the magnetic pole contacting with the blade member. The magnetized position contacting the blade member may have a pair of neighboring magnetic poles with the same polarization. A single magnetized position of the permanent magnet may have a pair of neighboing magnetic poles with the same polarization in an area from a developing zone to the blade member with respect to the rotational direction of the developing sleeve. Alternatively, a plurality of magnetized positions of the permanent magnet may have a pair of neighboring magnetic poles with the same polarization in an area from the developing zone to the blade member with respect to the rotational direction of the developing sleeve.

Since the blade member which is in sliding contact with the peripheral surface of the developing sleeve is provided at the upstream side immediately before the bristle cutting member with respect to the rotational direction of the developing sleeve, the mono-component magnetizable toner is flowing at all times at the upstream side of the bristle cutting member, and accordingly, the undesirable blocking phenomenon of the mono-component magnetizable toner by the bristle cutting member may be advantageously prevented. Meanwhile, owing to the fact that the mono-component magnetizable toner on the developing sleeve is once separated from the peripheral surface of the developing sleeve by the blade member during each rotation of the developing sleeve, the proper fluidity of the mono-component magnetizable toner can be positively achieved, with the state of bristle formation of the magnetic brush being uniformly maintained.

The developing material is supplied onto a developing roller having the developing sleeve disposed in the vicinity of a photosensitive material. There further is provided a storage container having a bottom formed in an arcuate-shape and extending downwardly, and having a supply port opening for supply of the developing material onto a peripheral surface of the developing roller. A rotary shaft is provided rotatably around the center of the arcuate bottom of the storage container, a stirring and feeding means stirs the developing material in the storage container to supply the same to the supply port and extends radially from the rotary shaft to the vicinity of the inner surface of the bottom of the strage container. A ratchet wheel is secured axially to the rotary shaft. A rocking lever has one end supported by a pin parallel to the rotary shaft and another end engaging to associate with the developing roller. The lever is swingable around the pin in accordance with the rotational motion of the developing roller. A claw is disposed on an immediate portion of the rocking lever to engage with teeth of the ratchet wheel and rotates the ratchet wheel in accordance with the swinging motion of the rocking lever. It thus is possible to prevent the undesirable blocking phenomenon by stirring the developing material in the storage container through comparatively simple construction, while the developing material accommodated within the storage container can be supplied by approximately a predetermined amount and almost without any remainder therein.

A device for detecting the presence of developing material includes a detecting member made of non-magnetic material and is swingable about a horizontal axis in a vertical plane with respect to an axis of the developing sleeve between a first angular position, corresponding to a substantially central position between adjacent N and S poles of the permanent magnet at a vicinity of the developing sleeve in accordance with the depressing force of the magnetizable toner attracted by the permanent magnet, and a second angular position spaced from the developing sleeve in accordance with the weight of the detection member against the depressing force of the developing material. The detecting member is disposed between the developing sleeve and the supply port of the developing material storage container. An engaging member is swingable about a horizontal axis and is formed with the detecting member. A switching means having an actuator engaging with the engaging member is switched at the first and second angular positions of the detecting member. Developing material supplied from the storage container is depressed as it is attracted by the permanent magnet so that the detecting member is subjected to angular displacement between the first angular displacement position and the second angular displacement position, with the switching state of the switch means being altered according to the angular displacement of the detecting member. Therefore, the presence or absence of the developing material on the peripheral surface of the developing sleeve can be readily detected. Furthermore, at the first angular displacement position, since the detecting member is positioned at approximately a central portion between N and S poles, the detecting member is readily subjected to angular displacement even by a slight depressing force from the developing material.

BRIEF DESCRIPTION OF THE DRAWINGS

A detailed description of the invention will be made with reference to the accompanying drawings, wherein like numerals designate corresponding parts in the several figures, and wherein.

DETAILED DESCRIPTION OF THE PREFERRED EMBODIMENTS

Figure 1:
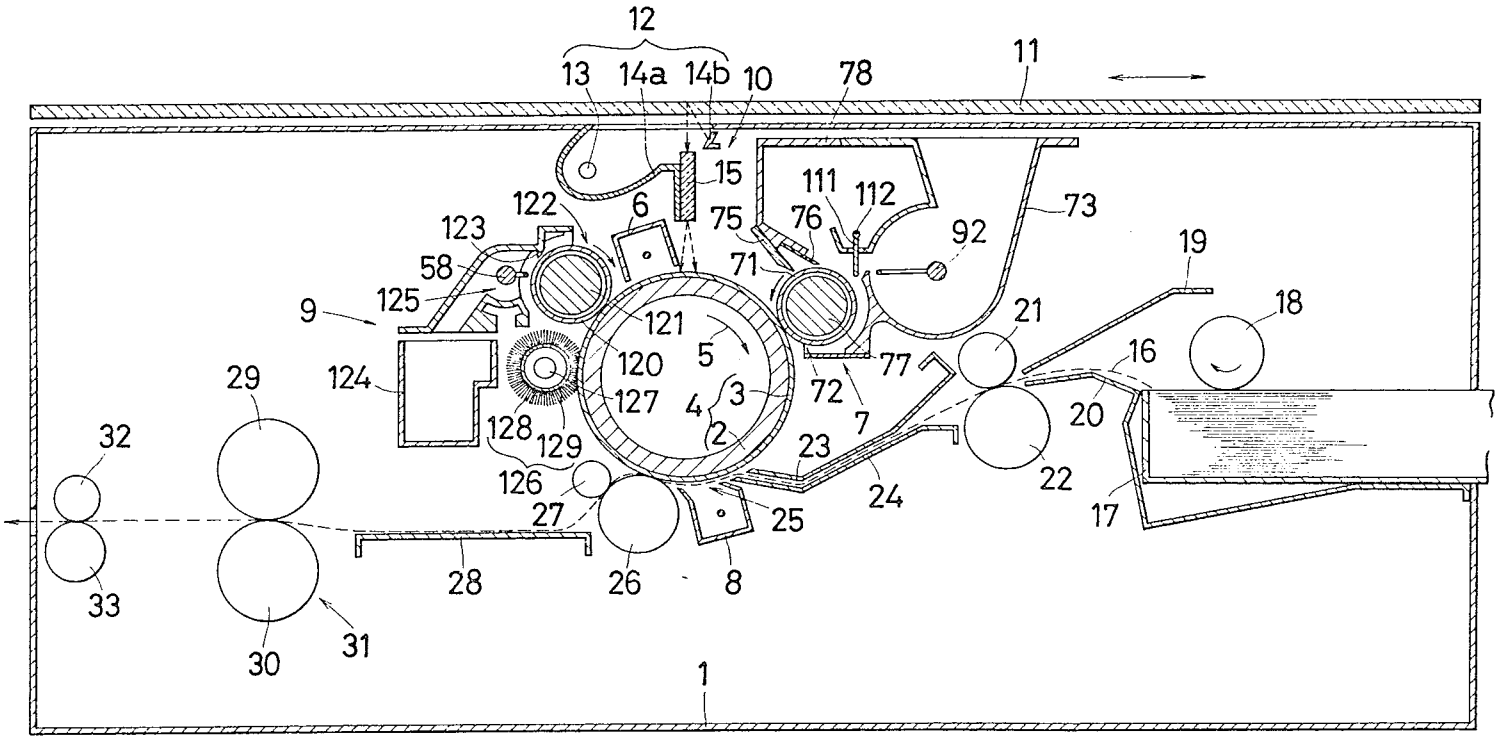
FIG. 1 is a simplified side sectional view of an electrostatic copying apparatus according to the invention.

Referring now to the drawings, there is shown in FIG. 1 a schematic side sectional view of a transfer type electrostatic copying machine according to one preferred embodiment of the invention. The copying apparatus of FIG. 1 includes a photosensitive or photoreceptor drum 4 having a photosensitive material or photoreceptor 3 provided on the entire peripheral surface of a drum 2, and rotatably mounted at approximately a central portion of a machine housing 1. Around the photoreceptor drum 4, there are sequentially disposed, along the rotational direction indicated by the arrow 5, a charging corona discharger 6 for preliminarily charging the photoreceptor 3, a developing device 7 for visualizing an electrostatic latent image formed on the photoreceptor 3 into a visible toner image, a transfer corona discharger 8 for transferring the toner image thus formed on the photoreceptor 3 onto a copy paper sheet, and a cleaning device 9 for cleaning off the toner remaining on the photoreceptor 3 after the transfer process.

Above the photoreceptor drum 4, there is provided an exposure device 10 for projecting a light-wise image of an original to be copied (not shown) onto the photoreceptor 3 in a position between the charging corona discharger 6 and the developing device 7, as shown by the dotted arrows. At the upper portion of the machine housing 1, an original carrier 11 is provided on which the original to be copied is horizontally placed for reciprocating movement as indicated by the double-headed arrow. In the exposure device 10, a light projecting means 12 for projecting light onto the original through the original carrier 11 further includes an exposure lamp 13, a reflector plate 14*a* and an auxiliary reflector plate 14*b*. The light projected towards the original placed on the original carrier 11 is focussed onto the photoreceptor 3 through a single focal point lens 15 to form the image of the original thereon, and thus, the electrostatic latent image is formed on the photoreceptor 3.

Along a copy paper transport passage 16 shown by a dotted line, the copy paper sheets stacked and accommodated in a paper feeding cassette 17 are fed, one sheet by one sheet, by a paper feeding roller 18 from the paper feeding cassette 17. The copy paper sheets are transported by a pair of feeding and transporting rollers 21 and 22 through upper and lower guide plates 19 and 20. A copy paper sheet fed into a transfer region 25 through another pair of upper and lower guide plates 23 and 24 is caused to closely adhere to the surface of the photoreceptor drum 4 confronting the transfer corona charger 8. After the transfer process, the copy paper sheet is held, at one edge thereof in the direction of the width thereof, between a separating roller 26 and an auxiliary separating roller 27 so as to be peeled off the surface of the photoreceptor drum 4, and is fed into a heat fixing device 31 having a pair of heat fixing rollers 29 and 30 through a guide plate 28. In heat fixing device 31, the toner image on the surface of the copy paper sheet is fixed. After the fixing process as described above, the copy paper sheet is discharged onto a copy paper tray (not shown) through a pair of discharging rollers 32 and 33.

Figure 2:
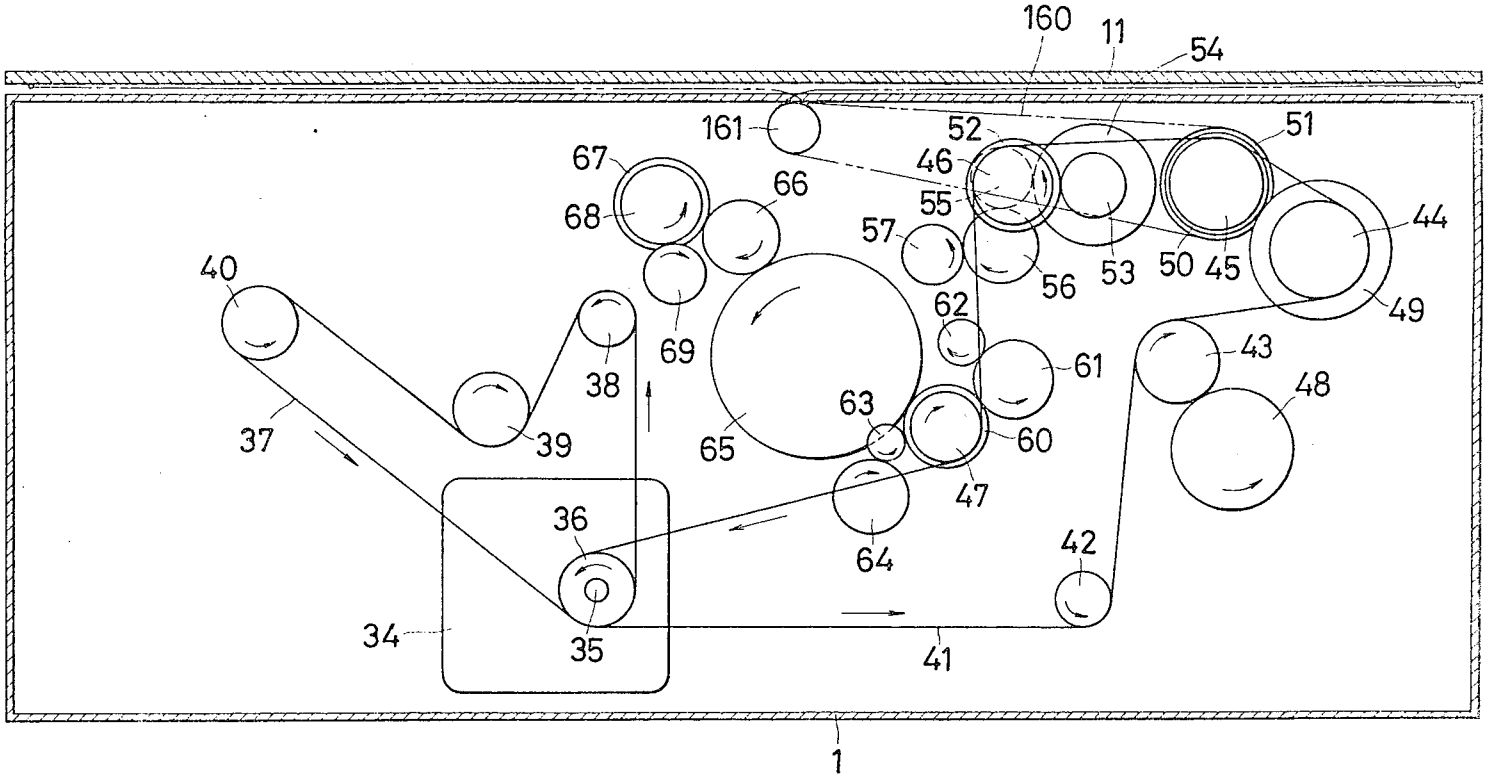
FIG. 2 is a schematic side sectional view of the copying apparatus of FIG. 1 as viewed from the reverse side thereof for illustrating its driving system.

Referring also to FIG. 2 showing a schematic side sectional view of the copying machine of FIG. 1 as viewed from the reverse side thereof for illustrating its driving system, to an output shaft 35 of a motor 34, there is secured a sprocket wheel 36, around which a first endless chain 37 is directed or passed. The chain 37 is sequentially passed around a sprocket wheel 38, a sprocket wheel 39 coupled to the feeding and transporting roller 22 and a sprocket wheel 40 connected to the copy paper feeding roller 18 along its running direction indicated by an arrow. Meanwhile, around another sprocket wheel (not shown) secured to the output shaft 35 so as to be one unit with the sprocket wheel 36, a second endless chain 41 is passed. The chain 41 is sequentially passed around sprocket wheels 42 and 43, two sprocket wheels 44 and 45 for driving the original carrier 11, and sprocket wheels 46 and 47 along its running direction indicated by an arrow. A gear (not shown) to be rotated as one unit with the sprocket wheel 43 is engaged with a gear 48 connected to the heat fixing roller 29. The sprocket wheel 44 is connected to a gear 49 through a clutch which is not shown, while the sprocket wheel 45 is coupled to a gear 50 and a pulley 51 through a clutch which is not shown, with the gears 49 and 50 being in mesh with each other. A cable or wire 160 connected at one end thereof to the right side end of the original carrier 11 as shown in FIG. 2 is further passed around pulley 51 from a pulley 161, and again around the pulley 161, and is connected at its other end to the left side end of the original carrier 11 in FIG. 2. By the changeover of a clutch (not shown), the pulley 51 is subjected to forward or reverse rotation, according to which the original carrier 11 is reciprocated in the directions shown by the double-headed arrow in FIG. 1. By the functions of the two clutches as described above, when the original carrier 11 is driven by the driving force from the sprocket wheel 44, original carrier 11 is caused to run at a comparatively high speed, while when the original carrier 11 is driven by the driving force from the sprocket wheel 45, it is caused to move at a comparatively low speed.

A gear 52 mounted on the same shaft as the sprocket wheel 46 is connected to a gear 57 through gears 53, 54, 55 and 56. The gear 56 is secured to a rotary shaft 58 of the cleaning device 9, while the gear 57 is concentrically fixed to a sleeve 120 of the cleaning device 9. A gear 60 to be rotated as one unit with the sprocket wheel 47 is connected through a gear 61 to a gear 62 which is coupled to a cylindrical member 128 of the cleaning device 9. Meanwhile, the gear 60 is connected to gear 64 associated with the separating roller 26 through a gear 63. Furthermore, the gear 60 is connected to a gear 65 which is integral with the photoreceptor drum 4, while the gear 65 is engaged with a gear 69 through gears 66, 67 and 68, with the gear 69 being connected to a developing sleeve 71 of the developing device 7.

Figure 3:
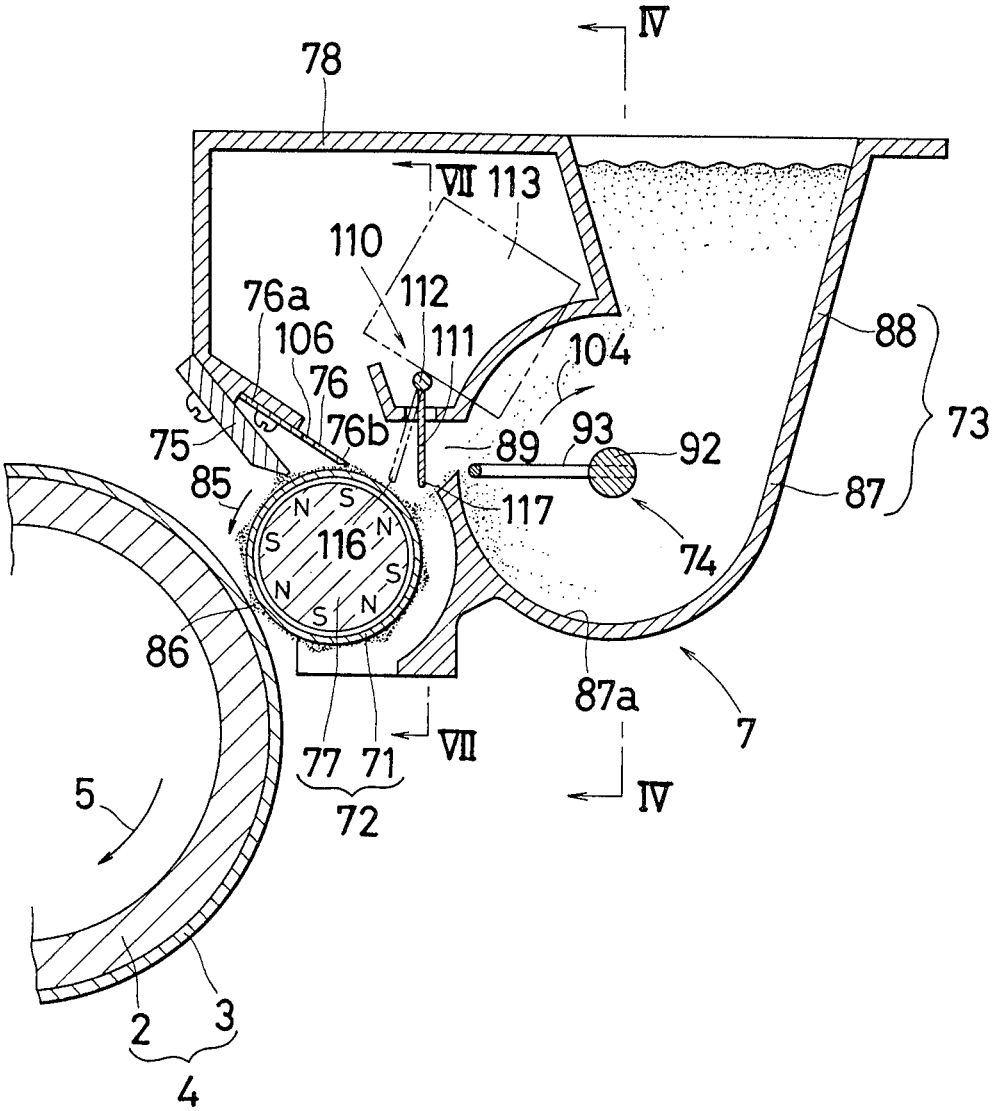
FIG. 3 is a fragmentary cross sectional view showing, on an enlarged scale, the arrangement in the vicinity of a developing device employed in the copying apparatus of FIG. 1.

Referring further to FIG. 3 showing on an enlarged scale from the front side the arrangement in the vicinity of the developing device 7 in FIG. 1, the developing device 7 further includes a developing roller 72 disposed in the vicinity of the photoreceptor 3 in a direction parallel with the axis of the photoreceptor drum 4, a storage container 73 for storing therein a mono-component magnetizable toner, as a developing material, a stirring and feeding means 74 operably housed in the storage container 73 for stirring the mono-component magnetizable toner therein and also for supplying the mono-component magnetizable toner onto the developing roller 72, a bristle cutting member 75 for restricting the length of the magnetic brush bristles to be formed on the peripheral surface of the developing roller 72, and a blade member 76 for once separating the magnetic brush from the peripheral surface of the developing roller 72 so as to bring it towards the bristle cutting member 75.

Figure 4:
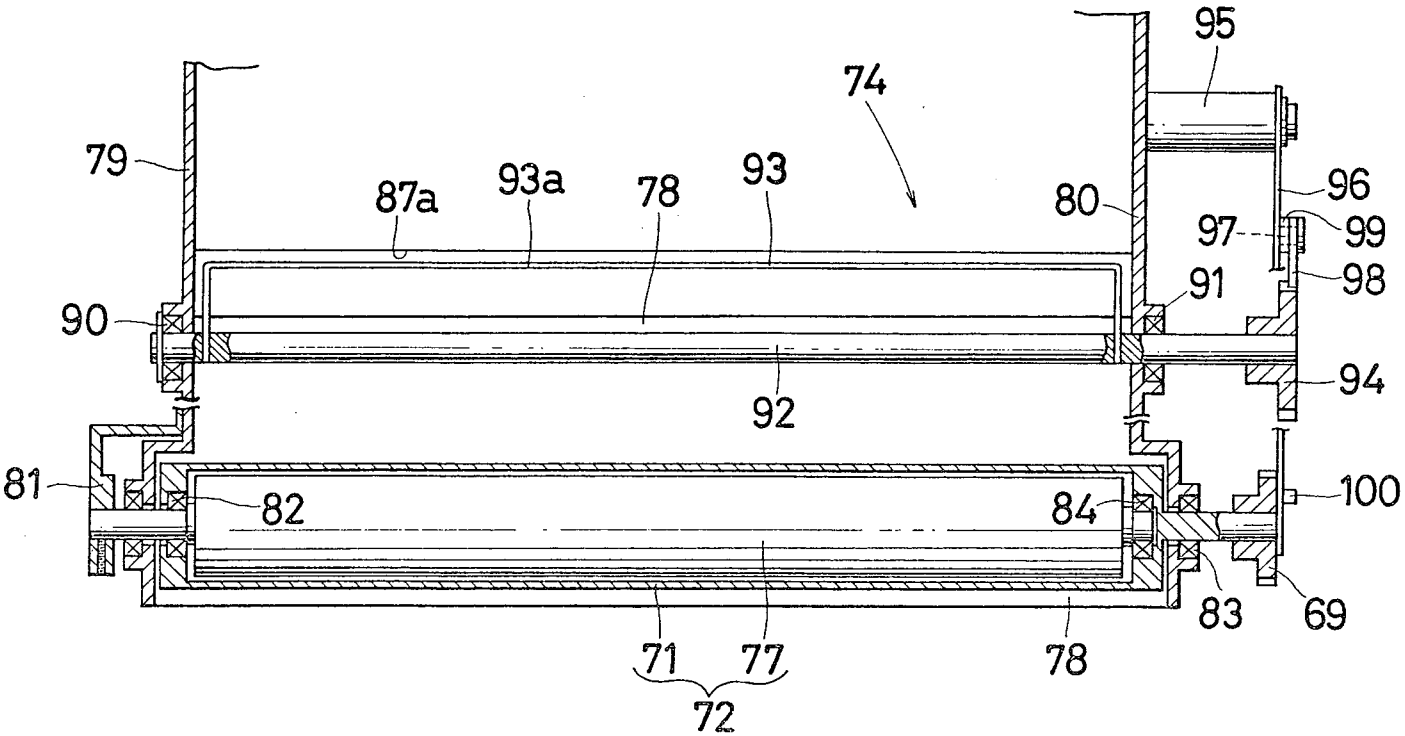
FIG. 4 is a schematic cross sectional view taken along the line IV—IV of FIG. 3.

Reference is also made to FIG. 4 showing a simplified cross section taken along the line IV-IV of FIG. 3. The developing roller 72 has a permanent magnet member 77 concentrically secured in the hollow developing sleeve 71 made of non-magnitizable material. One end of the permanent magnet member 77 extends through a corresponding end of the developing sleeve 71 through a bearing 82, and is fixed to a support member 81 secured to a front side plate 79 of a frame 78 of the developing device 7. On the other hand, the other end of the developing sleeve 71 extends through a rear side plate 80 of the frame 78 through a bearing 83, and is fixed with the gear 69. The other end of the permanent magnet member 77 is supported by the developing sleeve 71 through a bearing 84. The permanent magnet member 77 is magnetized by a plurality of magnetic poles circumferentially spaced at equal intervals, with neighboring magnetic poles being directed to have alternately opposite polar orientation. As described with reference to FIG. 2, by the transmission of driving force to the gear 69, and consequent rotation of the developing sleeve 71 in the direction shown by the arrow 85 in FIG. 3, the mono-component magnetizable toner supplied from the storage container 73 forms a magnetic brush on the developing sleeve 71. At a developing position 86, the peripheral surface of the photoreceptor 3 is rubbed against the magnetic brush, whereby the electrostatic latent image on the photoreceptor 3 is developed into a visible image.

Figure 5:
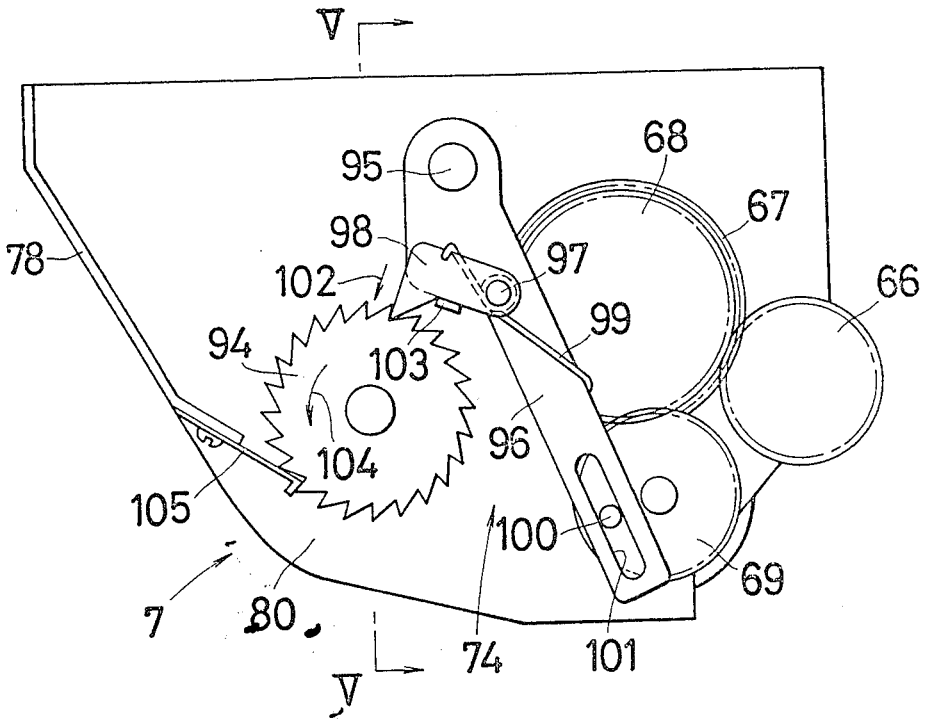
FIG. 5 is a schematic rear side view of the developing device of FIG. 3.

Referring to FIG. 3 and also to FIG. 5, showing a rear side view of the developing device 7, the storage container 73 includes an arcuate portion 87 having an arcuate shape in a vertical plane and extending in a direction parallel to the developing roller 72, and a conical portion 88 connected to the upper portion of the arcuate portion 87 at the side opposite to the developing roller 72 with respect to the central axis of the arcuate portion 87 and open upwardly as shown, and is formed into one unit with frame 78. At the side remote from the developing position 86 with respect to the developing roller 72, the arcuate portion 87 is formed with a supply port 89 for supplying the mono-component magnetizable toner onto the developing sleeve 72. The supply port 89 is defined above the developing roller 72 so that the mono-component magnetizable toner may be supplied onto the peripheral surface of the developing roller 72.

On the other hand, the stirring and supplying means 74 further includes a rotary shaft 92 journalled to the front and rear side plates 79 and 80 along the central axis of the arcuate portion 87 through bearings 90 and 91, a stirring and supplying member 93 integrally provided with the rotary shaft 92, a ratchet wheel 94 secured to one end of the rotary shaft 92, a rocking lever 96 pivotally supported at one end by a pin 95 provided on the rear side plate 80 and connected, at the other end thereof, to the gear 69 for rocking motion about pin 95 following rotation of the gear 69, a claw member 98 pivotally connected to an intermediate portion of the rocking lever 96 by a pin 97 for engagement with the teeth of the ratchet wheel 94, and a spring 99 which urges the claw member 98 towards the ratchet wheel 94.

The stirring and feeding member 93 extends parallel with and adjacent to an inner wall **87*a* of the arcuate portion 87 between the front and rear side walls 79 and 80, with its opposite end portions being bent at right angles so as to extend into and be secured to the rotary shaft 92. At a position deviated from the axis of the gear 69, a pin 100 is provided, while an elongated opening 101 is formed at the other end of the rocking lever 96 for engagement with the pin 100. The spring 99 is provided to surround the pin 97, with one end of the spring 99 being engaged with the rocking lever 96 and the other end of spring 99 engaged with the claw member 98. By the spring force of spring 99, the claw member 98 is urged about the pin 97 in the direction shown by the arrow 102. The rocking lever 96 is provided with a stopper piece 103 for restricting the rotation of the claw member 98**.

Through one rotation of the gear 69, i.e. by one rotation of the developing sleeve 71, the rocking lever 96 guided by the pin 100 engaged with the elongated opening 101 performs one reciprocating movement laterally as viewed in FIG. 5 about the pin 95, whereby the ratchet wheel 94 pushed by the claw member 98 connected to the rocking lever 96 is subjected to an angular displacement in the direction of the arrow 104. According to the angular displacement of the ratchet wheel 94, the rotary shaft 92 is also subjected to angular displacement by the same amount, with consequent angular displacement of the stirring and supplying member 93 integral with the rotary shaft 92. Therefore, the stirring and supply member 93 is rotated about the rotary shaft 92 following the rotational movement of the developing sleeve 71, whereby the mono-component magnetizable toner in the arcuate portion 87 is agitated, and is also brought to the supply port 89 by a longitudial portion **93*a* of the stirring and supply member 93. The mono-component magnetizable toner thus brought to the supply port 89 is fed from supply port 89 onto the peripheral surface of the developing sleeve 71. By stirring the mono-component magnetizable toner in the arcuate portion 87 through rotation of the stirring and supplying member 93, not only is blocking of the mono-component magnetizable toner within the storage container 73 prevented, but also a predetermined amount of the toner is always fed onto the peripheral surface of the developing sleeve 71 from the supply port 89. The number of revolutions of the stirring and supplying member 93 is so selected that the toner will not be absent on the peripheral surface of the developing sleeve 71, and in the embodiment described so far, it is arranged that the stirring and supplying member 93 completes one rotation, while the developing sleeve 71 makes 30 rotations, which may be achieved by suitably selecting the number of teeth of the ratchet wheel 94 and rocking distance of the claw member 98**.

Additionally, for preventing reverse rotation of the ratchet wheel 94, there is fixed, on the frame 78, a reverse rotation preventing member 105, which is arranged to contact with the teeth of the ratchet wheel 94 at a position downstream of the claw member 98 with respect to rotational direction 104.

Referring again to FIG. 3, in a position at the upstream side of the developing position 86 with respect to the rotational direction 85 of the developing sleeve 71, there is secured, to the frame 78, the bristle cutting member 75 closely confronting the peripheral surface of the developing sleeve 71. By bristle cutting member 75, the magnetic brush on the developing sleeve 71 is always restricted to have a predetermined bristle length as it is brought to the developing position 86. However, at the upstream side immediately before the bristle cutting member 75, there may occur a situation where the mono-component magnetizable toner to be cut off by the bristle cutting member 75 is solidified, thus giving rise to the so-called blocking phenomenon, which takes place due to depression of the mono-component magnetizable toner moving over the developing sleeve 71 by the bristle cutting member 75. Such phenomenon tends to occur more frequently as the force of the depression increases, i.e. as the number of revolutions of the developing sleeve 71 increases. Upon occurrence of the blocking phenomenon as described above, the formation of the magnetic brush on the developing sleeve 71 is blocked by the mono-component magnetizable toner and thus is not fed to the developing position 86, thus making it impossible to effect developing thereat. Meanwhile, at the developing position 86, the base portion of the magnetic brush does not contribute to development, and remains on the peripheral surface of the developing sleeve 71 as it is so as to continue rotation together with the developing sleeve 71. Accordingly, the toner on the developing sleeve 71 has a lowered fluidity, with an alteration in the ability for formation of the brush bristles, and thus, the developing efficiency is correspondingly reduced.

Therefore, the blade member 76 is provided at the upstream side of the bristle cutting member 75 with respect to the rotational direction 85. The blade member 76 described above is so inclined as to be spaced from the developing sleeve 71 towards the downstream side along the rotational direction 85, with a base portion **76*a* being secured to the frame 78, and a free end 76*b* thereof is arranged to slide on the developing sleeve 71 over its entire length at a scraping position. It is to be noted here that, in the permanent magnet member 77, the position thereof corresponding to the bristle cutting member 75 and the position which is in sliding contact with the free end 76*b* of the blade member 76, i.e. the scraping position, are magnetized by adjacent magnetic poles having mutually different polar orientation. In this embodiment as shown in FIG. 3, the position corresponding to the bristle cutting member 75 is magnetized with an N pole, while the position corresponding to the blade member 76** is magnetized with an S pole.

Figure 6:
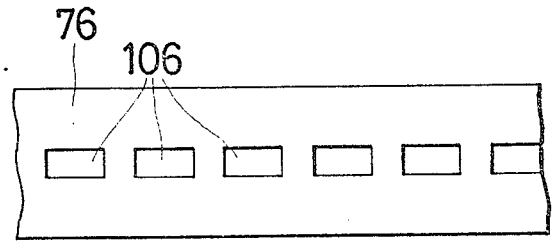
FIG. 6 is a fragmentary top plan view of a blade member.

In FIG. 6, showing a fragmentary too plan view of the blade member 76, a plurality of passing holes 106 are formed in the blade member 76 at a predetermined interval therebetween in the direction of width of blade member 76 (i.e. in a direction perpendicular to the paper surface of FIG. 3). These passing holes 106 are each formed at circumferential position approximately midway between the N pole (or S pole) corresponding to the position of bristle cutting member 75 and the S pole (or N pole) corresponding to position of blade member 76.

On the assumption that the mono-component megnetizable toner attracted onto the developing sleeve 71 by the magnetic force of the permanent magnet member 77 is brought to the position of the blade member 76 following rotation of the developing sleeve 71, since the blade member 76 is in sliding contact with the developing sleeve 71, the mono-component magnetizable toner on the developing sleeve 71 is peeled off or scraped off therefrom. Furthermore, owing to the inclination of the blade member 76 in an upstream direction with respect to the rotational direction 85, the mono-component magnetizable toner thus scraped off advances over the blade member 76 up to the position of the passing holes 106. Since the passing holes 106 are each formed at approximately a position midway between the N pole and S pole as described earlier, the magnetic attracting force exerting on the mono-component magnetizable toner at the passing holes 106 is directed in a directional normal to the magnetic lines of force, i.e. in a direction radially inwardly of the developing sleeve 71. Accordingly, the toner is readily supplied towards the inner side of the radial direction of the developing sleeve 71 from the passing holes 106 through the above described magnetic attracting force.

In the manner as described above, by the action of the blade member 76, the mono-component magnetizable toner, after being once separated from the peripheral surface of the developing sleeve 71, is caused to fall through the passing holes 106 to be fed onto the developing sleeve 71, and therefore, the toner is always fluidized immediately before the bristle cutting member 75, with the possibility of the occurrence of undesirable blocking being advantageously prevented. Moreover, since the mono-component magnetizable toner on the developing sleeve 71 is loosened or softened by the blade member 76 at every rotation of the developing sleeve 71, the bristles of the magnetic brush at the developing position 86 are formed in the same state at all times, with consequent improvements of the developing efficiency.

Figure 7:
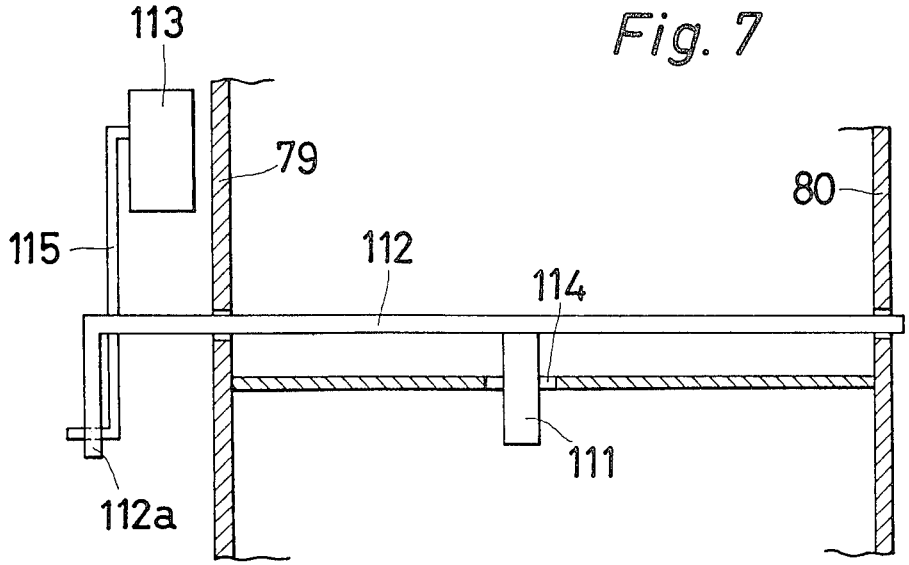
FIG. 7 is a schematic cross sectional view taken along the line VII—VII of FIG. 3.

Referring further to FIG. 7 showing a simplified cross section taken along the line VII-VII in FIG. 3, the developing apparatus 7 is provided with a detecting device 110 for detecting the presence of the toner (refer to both FIGS. 7 and 3). The detecting device 110 includes a detecting member 111 extending vertically between the supply port 89 of the storage container 73 and the developing roller 72, and pivotable in a plane at right angles with respect to the axis of the developing roller 72, an engaging member 112 extending in parallel relation with respect to the axis of the developing roller 72 and rotatably supported by the side plates 79 and 80, and a microswitch 113 as a switching means whose switched state is varied in response to the angular displacement of the engaging member 112.

The detecting member 111 extends vertically via a through-opening 114 defined in the frame 78 for restricting the range of angular displacement of detecting member 111, while the engaging member 112 is disposed above the through-opening 114. One end portion of the engaging member 112 is bent at a right angle at the outer side of the side plate 79, and the bent portion **112*a* thus formed is engaged with an actuator 115 of the microswitch 113**, which is coupled, for example, to a toner replenishing instruction means such as a pilot lamp or the like (not shown).

On the assumption that the mono-component magnetizable toner is being supplied onto the developing roller 72 through the supply port 89 of the storage container 73, since the mono-component magnetizable toner is attracted onto the peripheral surface of the developing sleeve 71 of the developing roller 72 by the attracting force of the permanent magnet member 77, the detecting member 111 is rotated in a direction approaching the developing roller 72 through depression by the mono-component magnetizable toner as shown by the imaginary lines in FIG. 3. At such first angular displacement position 116 of the detecting member 111, the free end of the detecting member 111 is located approximately at a central position between an N pole and an S pole of the permanent magnetic member 77, whereby the detecting member 111 comes to be readily subjected to the angular displacement through a slight depressing force by the mono-component magnetizable toner. Following the angular displacement of the detecting member 111 to the first angular displacement position 116, the engaging member 112 is also subjected to the angular displacement, according to which the microswitch 113 is cut off. Accordingly, the pilot lamp as described earlier is kept de-energized at the first angular displacement position 116.

When the supply of the mono-component megnetizable toner from the supply port 89 of the storage container 73 is suspended, with further disappearance of the toner on the peripheral surface of the developing sleeve 71, the depressing force by the monocomponent magnetizable toner is reduced, whereby the detecting member 111 is returned through rotation back to a second angular displacement position 117 shown by the solid lines in FIG. 3, by its own weight and the restoring force of the actuator 115 of the microswitch 113. By the angular displacement of the engaging member 112 following the rotational returning of the detecting member 111 to the second angular displacement position 117, the microswitch 113 is rendered conductive, with consequent illumination of the pilot lamp, and thus, it is indicated that the toner in the storage container 73 has been used up, with simultaneous absence of the toner on the peripheral surface of the developing sleeve 71.

It is to be noted here that the detecting member 111 and engaging member 112 should preferably be made to be light in weight as far as practicable so that they may be subjected to the angular displacement even by a slight depressing force of the toner.

Figure 8:
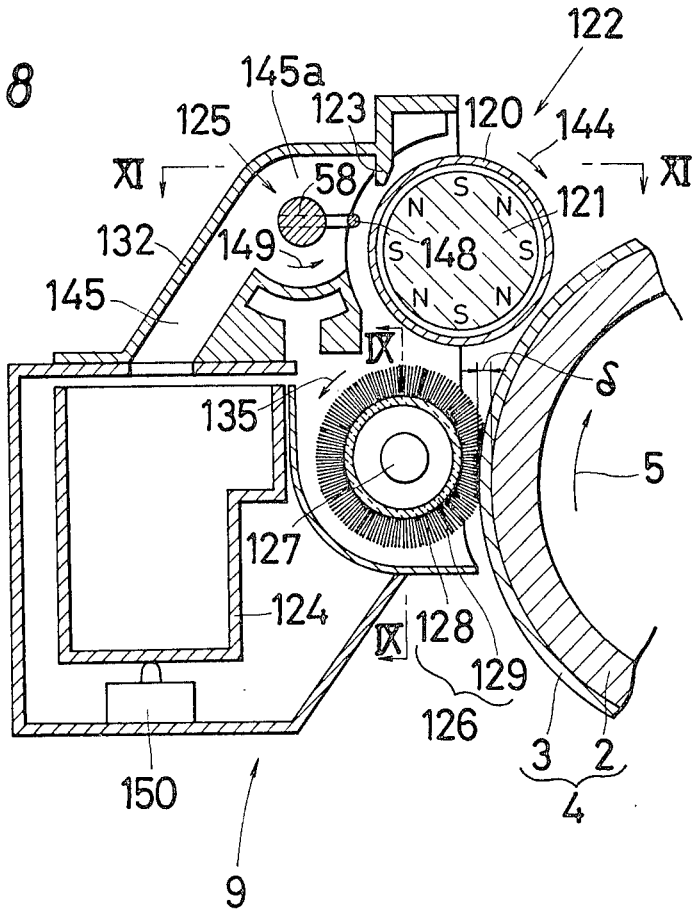
FIG. 8 is a fragmentary cross sectional view showing the arrangement in the vicinity of a cleaning device of FIG. 1.

Reference is also made to FIG. 8 showing, on an enlarged scale, a cross sectional view in the vicinity of the cleaning device 9. The cleaning device 9 generally includes a magnetic brush cleaning means 122 having a permanent magnet member 121 fixedly provided within a hollow sleeve 120 of non-magnetizable material which is driven for rotation, a restricting member 123 for restricting the bristle length of the magnetic brush to be formed on the peripheral surface of the sleeve 120, a toner receptacle 124 for receiving therein the toner removed by the magnetic brush cleaning means 122, a feed-in means 125 for forcibly feeding the remaining toner restricted by the restricting member 123 into the toner receptacle 124, a brush roller 126 provided at the upstream side of the magnetic brush cleaning means 122 with respect to the rotational direction 5 of the photoreceptor drum 4, and a charge eraser lamp 127 provided within the brush roller 126.

Figure 9:
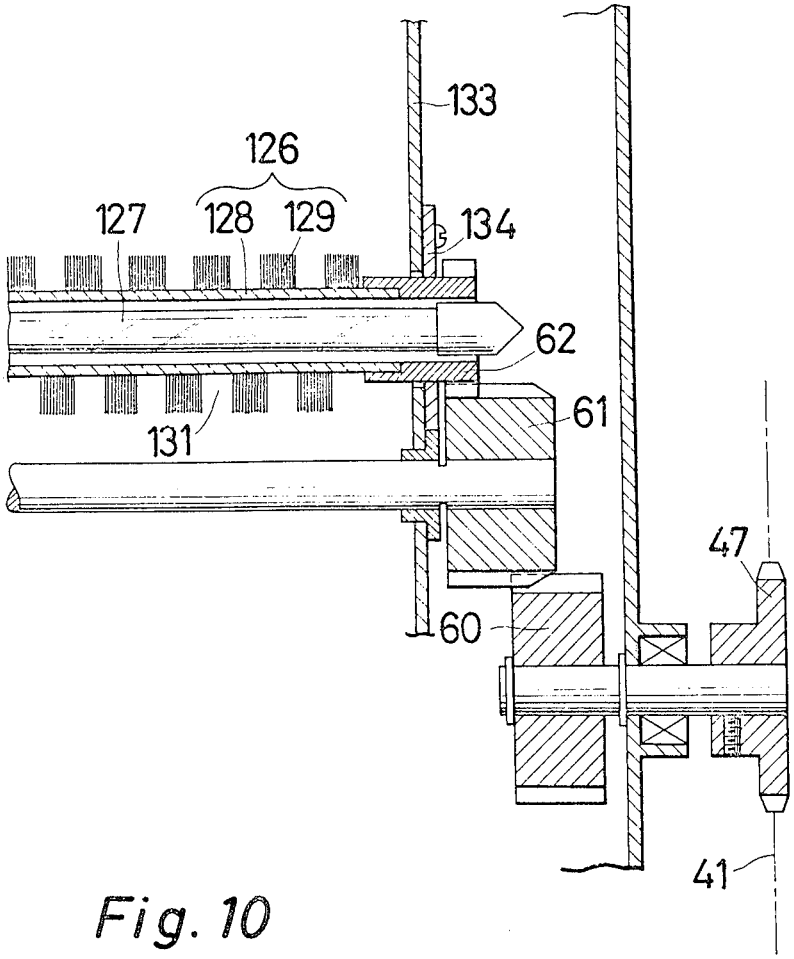
FIG. 9 is a fragmentary cross section taken along the line IX—IX of FIG. 8 showing the arrangement in the vicinity of a brush roller.
Figure 10:
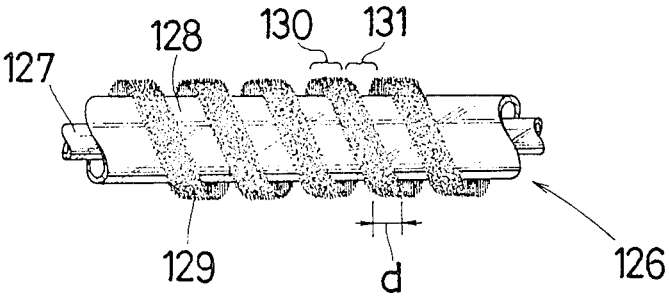
FIG. 10 is a fragmentary top plan view of the brush roller.

Referring further to FIG. 9 showing part of the arrangement in the vicinity of the brush roller 126 as viewed from the cross section taken along the line IX-IX of FIG. 8, the brush roller 126 is composed of a cylindrical member 128 of light transmitting material, for example, glass or the like, and a large number of brush bristles or brush hairs 129 of flexible material, for example, acrylic resin arranged on the outer peripheral surface of cylindrical member 120, and is disposed in a parallel relation with respect to the axis of the photoreceptor drum 4. As shown in FIG. 10, the brush bristles 129 are arranged on the outer peripheral surface of the cylindrical member 128 in a spiral configuration at a predetermined width d, with light transmitting portions 131 being formed between the neighboring bristle-filled portions 130 as shown. The length of the brush bristles 129 is so determined as to contact the peripheral surface of the photoreceptor drum 4 by a length $\delta$ from the free end of the bristles (FIG. 8). The length $\delta$ should suitably be in the region from 1 to 5 mm.

The opposite ends of the cylindrical member 128 are journalled by side plates 133 of a frame 132 of the cleaning device 9 through corresponding plain bearings 134. Within the cylindrical member 128, a charge eraser lamp 127 having a length longer than cylindrical member 128 is coaxially extended, while the opposite ends of the charge eraser lamp 127 are secured by supporting means (not shown). To one end of the cylindrical member 128, there is secured the earlier described gear 62, which is engaged with the gear 60 mounted on the same shaft as the sprocket wheel 47 through the gear 61. By the driving force transmitted from the sprocket wheel 47, the cylindrical member 128 is driven for rotation in the direction of the arrow 135 in FIG. 8. The speed of rotation of the brush roller 126 is so selected that the peripheral speed at the portion contacting the surface of the photoreceptor drum 4 becomes larger by 0 to 500 m/H, and more preferably, by 100 to 300 m/H, than the peripheral speed of the photoreceptor drum 4. By selecting the rotational speed of the brush roller 126 as described above, possible damage to the surface of the photoreceptor 3 by the sliding contact of the brush roller 126 with the photoreceptor drum 4 or undesirable scattering of the mono-component magnetizable toner over the photoreceptor 3 may be advantageously prevented.

Furthermore, by rotating the brush roller 126 at the peripheral speed difference as described above, the position of the mono-component magnetizable toner remaining on the photoreceptor 3 is deviated or shifted in the circumferential direction by the brush roller 126, whereby, upon projection of light of the charge eraser lamp 127 onto the surface of the photoreceptor 3 through the light transmitting portions 131, the light is directed onto portions of the photoreceptor 3 where the mono-component magnetizable toner is absent due to such shifting, and the charge on such portions is erased. Thus, the cleaning by the magnetic brush cleaning means 122 at the downstream side of the brush roller 126 with respect to the rotational direction 5 of the photoreceptor drum 4 is effectively carried out.

It is to be noted here that by arranging flexible and electrically conductive fine carbon fibers on the outer peripheral surface of the cylindrical member 128, triboelectrical charging due to sliding contact between the brush 129 and photoreceptor 3 may be prevented. Meanwhile, it may be so arranged that a material capable of cutting off light having a wavelength adversely affecting the photoreceptor 3 is employed for the cylindrical member 128, whereby the cylindrical member 128 may also serve as a filter of the charge eraser lamp 127.

In the foregoing embodiment, since the brush 129 is spirally arranged on the cylindrical member 128, the amount of light projection by the charge eraser lamp 127 onto the photoreceptor 3 may be properly determined by suitably setting the intervals of the light transmitting portions 131, the number of revolutions of the brush roller 126, and contact length δ of the brush roller 126 with respect to the photoreceptor 3.

Figure 11:
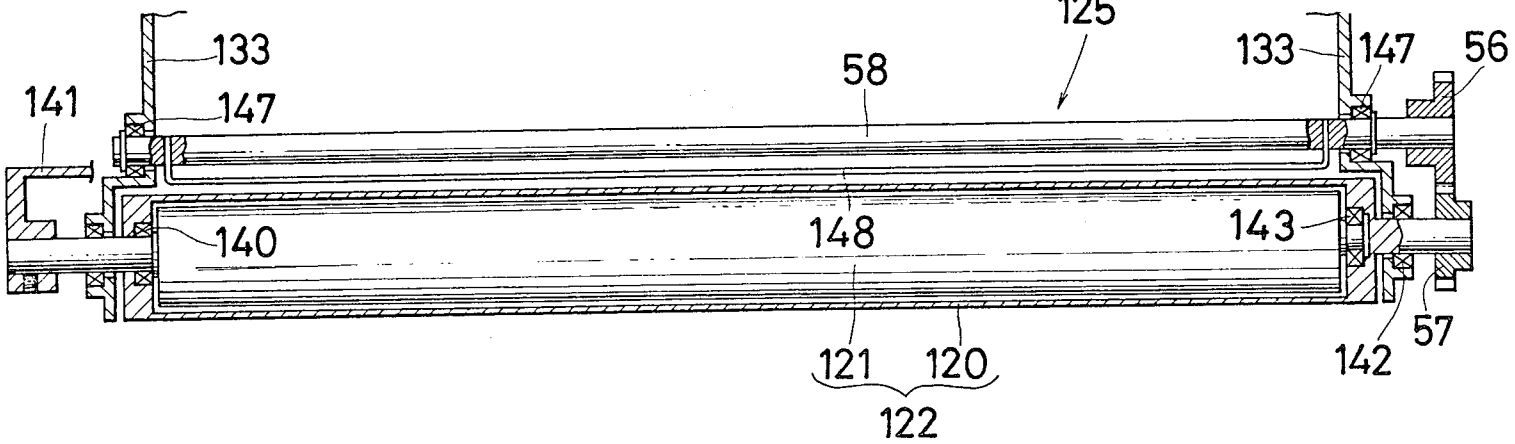
FIG. 11 is a schematic cross sectional view taken along the line XI—XI of FIG. 8.

Reference is also made to FIG. 11 showing a simplified cross section taken along the line XI—XI in FIG. 8, the magnetic brush cleaning means 122 is disposed at a position close to the photoreceptor 3 in a relation parallel to the axis of the photoreceptor drum 4. One end of the permanent magnet member 121 extending through one end of the sleeve 120 through a bearing 140 is secured to a support member 141 fixed to the side plate 133. Meanwhile, to the other end of the sleeve 120 which extends through the side plate 133 via a bearing 142 is fixed to the gear 57. The other end of the permanent magnet member 121 is supported by the sleeve 120 through a bearing 143. The permanent magnet member 121 is magnetized by magnetic poles equally spaced in the circumferential direction, with the neighboring magnetic poles directed to have alternately opposite polar orientation.

As described earlier with reference to FIG. 2, power is transmitted to the gear 57, whereby the sleeve 120 is rotated in the direction indicated by the arrow 144. (Refer to FIG. 8.) Accordingly, a magnetic brush having a bristle length determined by the restricting member 123 is formed so as to be in contact with the photoreceptor drum 4. As a result, the mono-component magnetizable toner remaining on the photoreceptor 3 is attracted onto the sleeve 120 through the magnetic attracting force of the permanent magnet member 121, and thus, is removed from the surface of the photoreceptor 3.

As was explained with reference to FIGS. 9 and 10, the toner remaining on the photoreceptor 3 is displaced over the peripheral surface of the photoreceptor 3 through action of the brush roller 126, while the charge on the entire peripheral surface of the photoreceptor 3 is erased, since the light from the charge eraser lamp 127 is projected thereonto through the light transmitting portions 131. Therefore, in the magnetic brush cleaning means 122, the toner on the photoreceptor 3 is readily attracted onto the sleeve 120, with a further improvement of the cleaning efficiency by the magnetic brush cleaning means 122.

Referring back to FIG. 8, in the magnetic brush cleaning means 122, at the side remote from the photoreceptor drum 4, the restricting member 123 is fixed to the frame 132 in a position close to the peripheral surface of the sleeve 120. By this restricting member 123, the bristle length of the magnetic brush on the sleeve 120 is restricted, while the feed-in means 125 is provided for feeding the surplus toner thus restricted into the toner receptacle 124. Still with reference to the magnetic brush cleaning means 122, at the side remote from the photoreceptor drum 4 and at a position lower than that of the magnetic brush cleaning means 122, the toner receptacle 124 is open at its upper portion, and between the magnetic brush cleaning means 122 and the toner receptacle 124, there is formed a passage 145 for feeding-in the toner. The toner feed-in means 125 is provided at the upstream side of the restricting member 123 with respect to the rotational direction 144 of the sleeve 120 at an opening **145*a* of the passage 145 at the side of the cleaning means 122. Referring again to FIG. 11, the feed-in means 125 includes the rotary shaft 58 supported, at opposite ends thereof, by the corresponding side plates 133 through bearings 147, and a toner transport member 148 of non-magnetizable material provided as one unit with the rotary shaft 58. To the rotary shaft 58, the gear 56 is fixedly mounted, and by the driving force to be transmitted to the gear 56, the rotary shaft 58 is rotated in the direction indicated by the arrow 149. (Refer to FIG. 8.) The toner transport member 148 is arranged to extend in a relation parallel to the rotary shaft 58, with opposite ends thereof bent at right angles and secured to the rotary shaft 58. The rotational direction 149 of the rotary shaft 58 is selected to be opposite to that of the sleeve 120, whereby the surplus mono-component magnetizable toner restricted by the restricting member 123 is transported by the toner transport member 148 so as to be positively brought into the passage 145. The mono-component magnetizable toner thus fed into the passage 145 falls in the passage 145 by its own weight into the toner receptacle 124**.

Still referring to FIG. 8, the toner receptacle 124 is placed on a microswitch 150 as a switching means, which is set to be rendered conductive when the mono-component toner to be accommodated in the toner receptacle 124 reaches a predetermined weight. The microswitch 150 as described above is connected to a toner collection indicating means such as a pilot lamp or the like, and is arranged to illuminate the pilot lamp when the weight of the mono-component magnetizable toner within the toner receptacle 124 has reached a predetermined level. Accordingly, it is readily detected when the toner receptacle 124 has been filled with the mono-component magnetizable toner.

Figure 12:
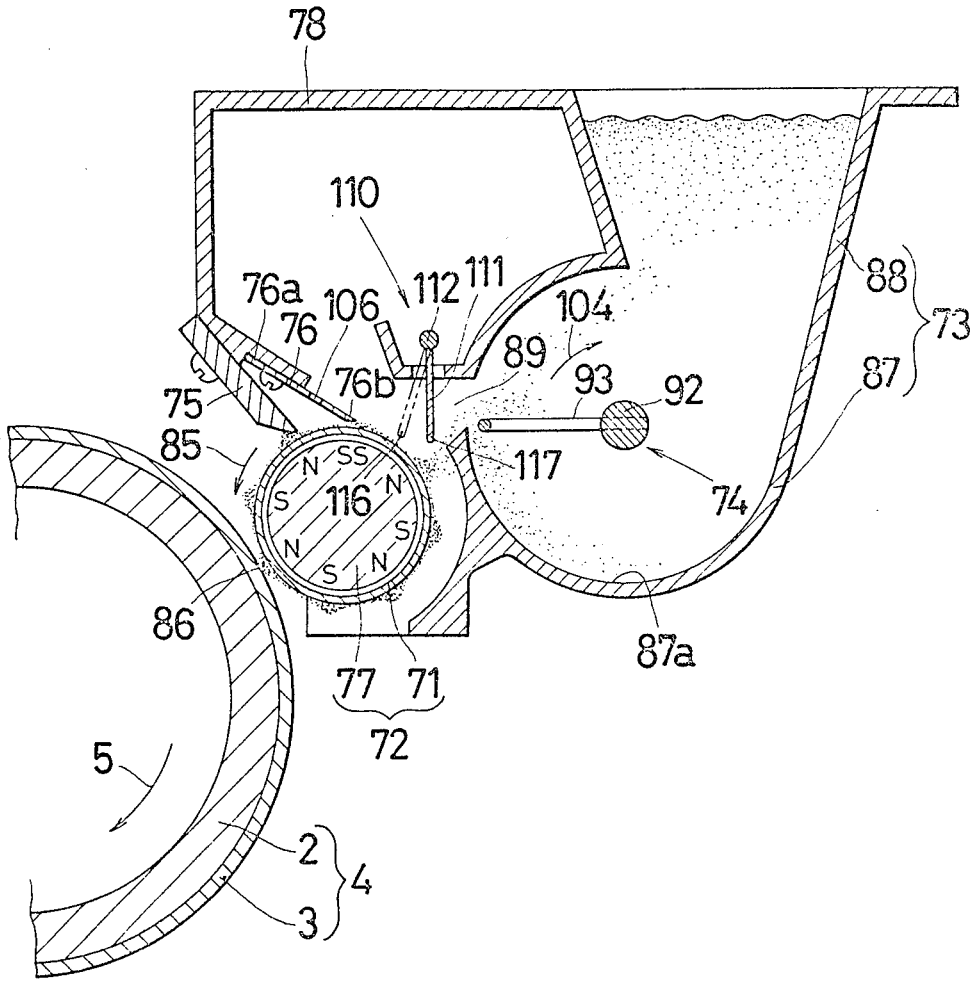
FIG. 12 is a cross sectional view showing the developing device according to another aspect of the invention.

Reference is made to FIG. 12 showing a cross sectional view of a developing apparatus according to another embodiment of the present invention, by which the developing apparatus 7 of the embodiment of FIGS. 1 through 11 may be replaced.

In the embodiment of FIG. 12, the permanent magnet member 77 is magnetized by a pair of magnetic poles (S poles in this embodiment) having the same polarity in a position corresponding to the position of sliding contact of the blade member 76 with the developing sleeve 71. By experiments carried out by the present inventors, a remarkable effect has been obtained when the magnetic poles are disposed at intervals of 2 to 6 mm around the circumferential surface of the parmanent magnet member 77. Meanwhile, in a position corresponding to the bristle cutting member 75, the magnet member 77 is magnetized by a magnetic pole adjacent the pair of magnetic poles (S poles in this embodiment) and has a polarity opposite thereto (N pole in this embodiment). Since the other constructions of the developing device of FIG. 12 are generally similar to those of the arrangement of FIG. 3, detailed description thereof is omitted here for the sake of brevity.

By magnetizing the permanent magnet member 77 with the pair of magnetic poles of the same polarity at the position for sliding contact of the blade member 76, the attracting force for attracting the mono-component magnetizable toner onto the developing sleeve 71 at the sliding contact position of the blade member 76 is weakened. Moreover, since the magnetic lines of force from the magnetic poles of the same polarity are directed in the radial direction of the developing sleeve 71, the mono-component magnetizable toner is subjected to the magnetic attracting force in the tangential direction of the developing sleeve 71. Therefore, the mono-component magnetizable toner on the developing sleeve 71 is separated from the surface of the developing sleeve 71 at a position before the sliding contact position of the blade member 76, and jumps over the sliding contact position to be transferred to the blade member 76, and thus, reaches the passing holes 106. Accordingly, in the above arrangement, it is not necessary to cause the blade member 76 to strongly contact the sleeve 71, and therefore, undesirable blocking of the toner by the blade member 76 can be prevented.

Figure 13:
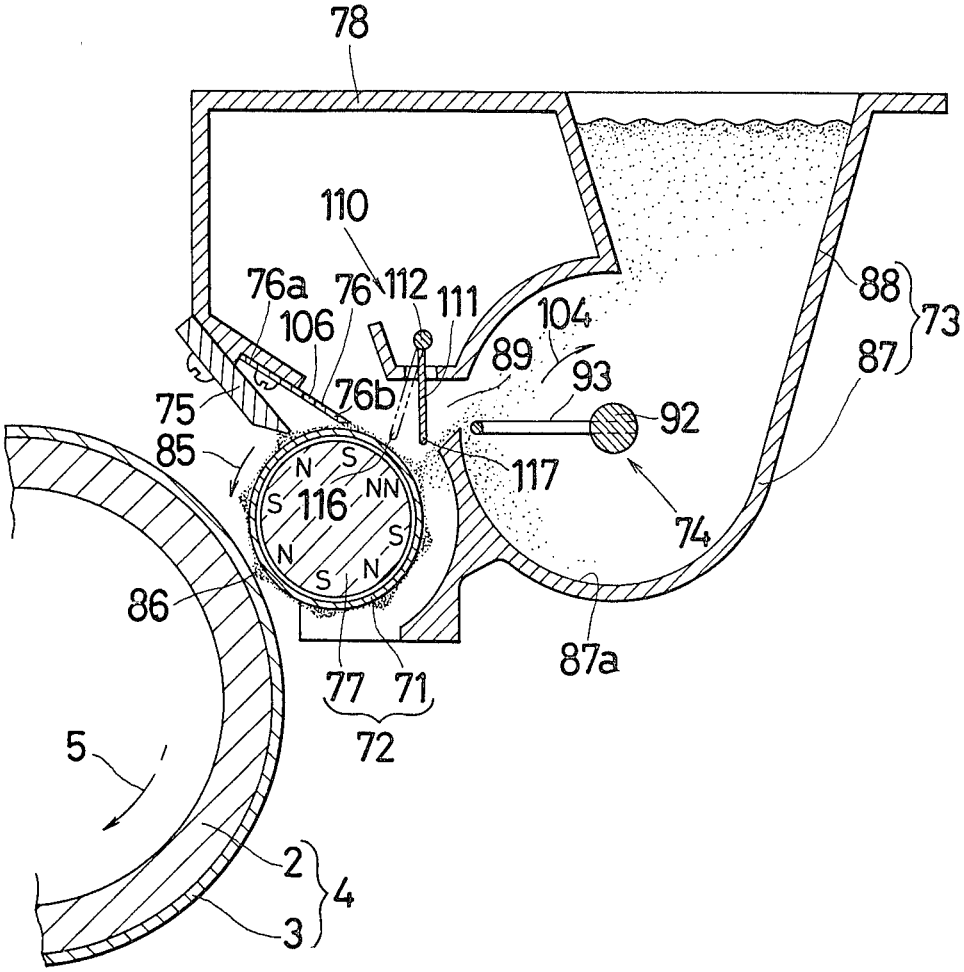
FIG. 13 is a cross sectional view showing the developing device according to still another aspect of the invention.

Referring to FIG. 13, there is shown, on an enlarged scale, a cross section of a developing apparatus according to a further embodiment of the invention, in which like parts corresponding to those in FIG. 3 are designated by like reference numerals.

In the embodiment of FIG. 13, the permanent magnet member 77 is magnetized by a pair of magnetic poles having the same polarity (N poles in this embodiment) located in the peripheral area or range from the developing position 86 to the blade member 76 along the rotational direction 85 of the developing sleeve 71. These magnetic poles are arranged, for example, at intervals of 2 to 6 mm around the circumferential surface of the permanent magnet member 77. Since other constructions are generally similar to those of the arrangement of FIG. 3, detail description thereof is also omitted here for the sake of brevity.

By the arrangement of FIG. 13 as described above, the mono-component magnetizable toner of the magnetic brush formed on the surface of the developing sleeve 71 not contributing to developing, and rotated together with the developing sleeve 71 from the developing position 86 is temporarily displaced when it passes the position at which the pair of magnetic poles of the same polarity are disposed close to each other. The above displacement takes place because, in the region between the developing position 86 and the position at which the pair of magnetic poles of the same polarity are disposed, the regular variation of the formation and structure of the magnetic brush due to the alternate arrangement of the N poles and S poles is interrupted and shifted and caused to be out of phase. Accordingly, since the mono-component magnetizable toner whose magnetizing function is thus weakened is transported up to the position of the blade member 76, the toner may be easily peeled off or scraped off from the peripheral surface of the developing sleeve 71.

It should be noted that the position at which the pair of magnetic poles of the same polarity close to each other are to be magnetized is not limited to be one position as described in the above arrangement of FIG. 13, but may be further modified to be provided at a plurality of spots in the peripheral area from the developing position 86 to the blade member 76 along the rotational direction 85.

Figure 14:
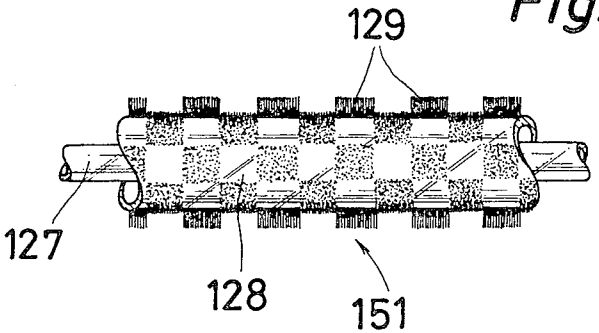
FIG. 14 is a fragmentary top plan view showing a brush roller according to still further aspect of the invention.

Referring to FIG. 14, there is shown a top plan view of a modified brush roller 151 according to the present invention, which may replace the brush roller 126 in the embodiment of FIGS. 1 through 11. As shown in the modified hair FIG. 14, the modified brush roller 151 may be formed by arranging the brush 129 on the peripheral surface of the cylindrical member 128 in a lattice-like or checkerboard pattern.

Figure 15:
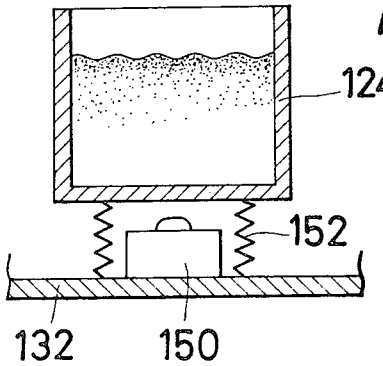
FIG. 15 is a fragmentary cross sectional view showing the arrangement of a toner receptacle according to another aspect of the invention.

Reference is further made to FIG. 15 showing a cross section of an arrangement for the toner receptacle according to a still further embodiment of the present invention. As shown in the arrangement of FIG. 15, the toner receptacle 124 may be so arranged as to be placed on the frame 132 through a spring 152 so that, when the spring 152 is compressed by the weight of the mono-component magnetizable toner accumulated within the toner receptacle 124 and the amount of the mono-component magnetizable toner has reached a predetermined value, the microswitch 150 is rendered to be conductive, by which arrangement the detection weight can be adjusted by the adjustment of the spring force of the spring 152.

What is claimed is:

1. A developing device for use in an electrostatic copying apparatus to transform an electrostatic latent image formed on a photoreceptor into a visible toner image, said device comprising:

a developing roller adapted to be positioned adjacent a photoreceptor and including a fixedly positioned permanent magnet and a hollow developing sleeve formed of a non-magnetic material and mounted coaxially about said permanent magnet for rotation thereabout, whereby one-component magnetizable toner supplied to the periphery of said sleeve forms thereon a magnetic brush which is conveyed by rotation of said sleeve to a developing position whereat the toner is transferred to the photoreceptor as a visible toner image;

a bristle cutting member, positioned upstream of said developing position with respect to the direction of rotation of said sleeve, for restricting the length of the magnetic brush;

means for preventing solidification of the toner on said periphery of said sleeve, said preventing means comprising a blade member formed of a non-magnetizable material and positioned upstream of said bristle cutting member, said blade member being in sliding contact with said periphery of said sleeve at a scraping position and being inclined away from said periphery in a direction downstream from said scraping position, whereby toner scraped from said periphery by said blade member is moved away from said periphery in said downstream direction by said blade member;

said permanent magnet having spaced therearound at equal circumferential intervals a plurality of magnetizing positions having magnetic poles, one said pole being at a first said magnetizing position confronting said bristle cutting member, a pair of said poles being at a second said magnetizing position confronting said scraping position, said pair of poles being adjacent said one pole, said pair of poles being of the same polarity and opposite to the polarity of said one pole, and adjacent said poles other than said pair of poles having alternately opposite polarities; and said blade member having means for returning to said periphery said toner scraped therefrom, at a position substantially midway between said second and first magnetizing positions.

2. A device as claimed in claim 1, wherein said returning means comprises holes formed in said blade member.

3. A developing device for use in an electrostatic copying apparatus to transform an electrostatic latent image formed on a phosotoreceptor into a visible toner image, said device comprising:

a developing roller adapted to be positioned adjacent a photoreceptor and including a fixedly positioned permanent magnet and a hollow developing sleeve formed of a non-magnetic material and mounted coaxially about said permanent magnet for rotation thereabout, whereby one-component magnetizable toner supplied to the periphery of said sleeve forms thereon a magnetic brush which is conveyed by rotation of said sleeve to a developing position whereat the toner is transfered to the photoreceptor as a visible toner image;

a bristle cutting member, position upstream of said developing position with respect to the direction of rotation of said sleeve, for restricting the length of the magnetic brush;

means for preventing solidification of the toner on said periphery of said sleeve, said preventing means comprising a blade member formed of a non-magnetizable material and positioned upstream of said bristle cutting member, said blade member being in sliding contact with said periphery of said sleeve at a scraping position and being inclined away from said periphery in a direction downstream from said scraping position, whereby toner scraped from said periphery by said blade member is moved away from said periphery in said downstream direction by said blade member;

said permanent magnet having spaced therearound at equal circumferential intervals a plurality of magnetizing positions having magnetic poles, a first said pole being at a first said magnetizing position confronting said bristle cutting member, a second said pole being at a second said magnetizing position confronting said scraping position, said second pole being adjacent said first pole, said first and second poles having opposite polarities, a pair of said poles being at a third magnetizing position at a single location in a peripheral area between said developing position and said scraping position, said pair of poles being of the same polarity, and adjacent said poles other than said pair of poles having alternately opposite polarities; and said blade member having means of returning to said periphery said toner scraped therefrom, at a position substantially midway between said second and first magnetizing positions.

4. A device as claimed in claim 3, wherein said returning means comprises holes formed in said blade member.

5. A developing device for use in an electrostatic copying apparatus to transform an electrostatic latent image formed on a photoreceptor into a visible toner image, said device comprising:

a developing roller adapted to be positioned adjacent a photoreceptor and including a fixedly positioned permanent magnet and a hollow developing sleeve formed of a non-magnetic material and mounted coaxially about said permanent magnet for rotation thereabout, whereby one-component magnetizable toner supplied to the periphery of said sleeve forms thereon a magnetic brush which is conveyed by rotation of said sleeve to a developing position whereat the toner is transferred to the photoreceptor as a visible toner image;

a bristle cutting member, positioned upstream of said developing position with respect to the direction of rotation of said sleeve, for restricting the length of the magnetic brush;

means for preventing solidification of the toner on said periphery of said sleeve, said preventing means comprising a blade member formed of a non-magnetizable material and positioned upstream of said bristle cutting member, said blade member being in sliding contact with said periphery of said sleeve at a scraping position and being inclined away from said periphery in a direction downstream from said scraping position, whereby toner scraped from said periphery by said blade member is moved away from said periphery in said downstream direction by said blade member;

said permanent magnet having spaced therearound at equal circumferential intervals a plurality of magnetizing positions having magnetic poles, a first said pole being at a first said magnetizing position confronting said bristle cutting member, a second said pole being at a second said magnetizing position confronting said scraping position, said second pole being adjacent said first pole, said first and second poles having opposite polarities, said poles at adjacent said magnetizing positions having alternately opposite polarities, each of a plurality of said magnetizing positions in a peripheral area between said developing position and said scraping position having a pair of said poles, each said pair of poles being of the same polarity; and said blade member having means for returning to said periphery said toner scraped therefrom, at a position substantially midway between said second and first magnetizing positions.

6. A device as claimed in claim 5, wherein said returning means comprises holes formed in said blade member.

7. A developing device for use in an electrostatic copying apparatus to transform an electrostatic latent image formed on a photoreceptor into a visible toner image, said device comprising:

a developing roller adapted to be positioned adjacent a photoreceptor and including a fixedly positioned permanent magnet and a hollow developing sleeve formed of a non-magnetic material and mounted coaxially about said permanent magnet for rotation thereabout, whereby one-component magnetizable toner supplied to the periphery of said sleeve forms thereon a magnetic brush which is conveyed by rotation of said sleeve to a developing position whereat the toner is transferred to the photoreceptor as a visible toner image;

a bristle cutting member, positioned upstream of said developing position with respect to the direction of rotation of said sleeve, for restricting the length of the magnetic brush;

means for preventing solidification of the toner on said periphery of said sleeve, said preventing means comprising a blade member formed of a non-magnetizable material and positioned upstream of said bristle cutting member, said blade member being in sliding contact with said periphery of said sleeve at a scraping position and being inclined away from said periphery in a direction downstream from said scraping position, whereby toner scraped from said periphery by said blade member is moved away from said periphery in said downstream direction by said blade member;

said permanent magnet having spaced therearound at equal circumferential intervals a plurality of magnetic poles;

a toner storage container having an arcuate bottom and a supply port for supplying toner from said container to said periphery of said sleeve;

a rotary shaft rotatably positioned at the center of said arcuate bottom of said container;

means for stirring said toner within said container and for feeding said toner therefrom through said supply port, said stirring and feeding means comprising a member fixed to and extending radially from said rotary shaft for a length to be positioned adjacent said arcuate bottom of said container;

a rachet wheel fixed to said rotary shaft adjacent an axial end thereof;

a rocking lever having a first end mounted for rotation about a pin extending parallel to said rotary shaft and a second end;

means for engaging said second end of said rocking lever to said sleeve such that rotation of said sleeve reciprocally swings said rocking lever about said pin; and claw means, positioned on an intermediate portion of said rocking lever, and engaging with teeth of said ratchet wheel, for rotating said ratchet wheel, and thereby said rotary shaft and said member fixed thereto, in response to swinging movement of said rocking lever.

8. A developing device for use in an electrostatic copying apparatus to transform an electrostatic latent image formed on a photoreceptor into a visible toner image, said device comprising:

a developing roller adapted to be positioned adjacent a photoreceptor and including a fixedly positioned permanent magnet and a hollow developing sleeve formed of a non-magnetic material and mounted coaxially about said permanent magnet for rotation thereabout, whereby one-conponent magnetizable toner supplied to the periphery of said sleeve forms thereon a magnetic brush which is conveyed by rotation of said sleeve to a developing position whereat the toner is transferred to the photoreceptor as a visible toner image;

a bristle cutting member, positioned upstream of said developing position with respect to the direction of rotation of said sleeve, for restricting the length of the magnetic brush;

means for preventing solidification of the toner on said periphery of said sleeve, said preventing means comprising a blade member formed of a non-magnetizable material and positioned upstream of said bristle cutting member, said blade member being in sliding contact with said periphery of said sleeve at a scraping position and being inclined away from said periphery in a direction downstream from said scraping position, whereby toner scraped from said periphery by said blade member is moved away from said periphery in said downstream direction by said blade member;

said permanent magnet having spaced therearound at equal circumferential intervals a plurality of magnetic poles;

a toner storage container having a supply port for supplying toner from said container to said periphery of said sleeve; and means for detecting the presence of toner being supplied from said supply port to said periphery of said sleeve, said detecting means comprising a detecting member formed of a non-magnetizable material and mounted between said sleeve and said supply port for swinging movement in a vertical plane about a horizontal axis parallel to the axis of said sleeve between a first angular position, whereat said member is pressed by said magnetizable toner supplied through said supply port and attracted by said permanent magnet to a location toward said sleeve generally midway between adjacent N and S poles of said permanent magnet, and a second angular position, whereat said member is spaced from said sleeve due to the weight of said member against the pressing force of said toner, an engaging member integral with said detecting member and swingable thereby about said horizontal axis, and a switch having an actuator engaged with said engaging member and movable thereby to change switching modes in response to movement of said detecting member between said first and second angular positions thereof.

* * * * *